US010113370B2

(12) United States Patent
Slay et al.

(10) Patent No.: US 10,113,370 B2
(45) Date of Patent: Oct. 30, 2018

(54) FLUID FLOW CONTROL DEVICE

(71) Applicant: Halliburton Energy Services, Inc., Houston, TX (US)

(72) Inventors: Jeremy Buc Slay, Fort Worth, TX (US); Russell Irving Bayh, III, Carrollton, TX (US); Donald Gay Kyle, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 238 days.

(21) Appl. No.: 14/441,214

(22) PCT Filed: Nov. 26, 2013

(86) PCT No.: PCT/US2013/072010
§ 371 (c)(1),
(2) Date: May 7, 2015

(87) PCT Pub. No.: WO2015/080702
PCT Pub. Date: Jun. 4, 2015

(65) Prior Publication Data

US 2016/0047172 A1 Feb. 18, 2016

(51) Int. Cl.

| | |
|---|---|
| ***E21B 41/00*** | (2006.01) |
| ***E21B 17/00*** | (2006.01) |
| ***E21B 43/16*** | (2006.01) |
| ***E21B 43/24*** | (2006.01) |

(52) U.S. Cl.
CPC ..... *E21B 17/00* (2013.01); *E21B 41/00* (2013.01); *E21B 43/16* (2013.01); *E21B 43/24* (2013.01)

(58) Field of Classification Search
CPC ..... E21B 17/00; E21B 43/16; E21B 43/24
See application file for complete search history.

(56) References Cited

U.S. PATENT DOCUMENTS

| | | | | |
|---|---|---|---|---|
| 6,675,891 | B2 * | 1/2004 | Hailey, Jr. | E21B 43/045 166/228 |
| 8,037,940 | B2 | 10/2011 | Patel et al. | |
| 2003/0141072 | A1 * | 7/2003 | Cove | E21B 33/035 166/368 |
| 2004/0154806 | A1 | 8/2004 | Bode et al. | |
| 2005/0150657 | A1 | 7/2005 | Howard et al. | |
| 2006/0048942 | A1 | 3/2006 | Moen et al. | |

(Continued)

OTHER PUBLICATIONS

International Preliminary Report on Patentability issued in related Application No. PCT/US20131072010, dated Jun. 9, 2016 (11 pages).

(Continued)

*Primary Examiner* — Brad Harcourt
(74) *Attorney, Agent, or Firm* — Scott Richardson; Baker Botts L.L.P.

(57) ABSTRACT

A downhole fluid flow control apparatus is disclosed. The fluid flow control apparatus includes a substantially tubular housing. In one embodiment, the fluid flow control device includes an inner diameter and an outer diameter, the inner diameter having a profile defined by one or more contour lines. The fluid flow control apparatus further includes a plurality of circular orifices defined on the tubular housing. In another embodiment, the fluid flow control apparatus includes a plurality of slotted orifices defined on the tubular housing.

19 Claims, 3 Drawing Sheets

(56) References Cited

U.S. PATENT DOCUMENTS

| | | | | |
|---|---|---|---|---|
| 2008/0251255 | A1 | 10/2008 | Forbes et al. | |
| 2009/0020292 | A1* | 1/2009 | Loretz | E21B 43/14 166/373 |
| 2011/0139453 | A1* | 6/2011 | Schultz | E21B 43/12 166/272.3 |

OTHER PUBLICATIONS

International Search Report and Written Opinion issued in related PCT Application No. PCT/US2013/072010 dated Aug. 24, 2014, 14 pages.

* cited by examiner

FLUID FLOW CONTROL DEVICE

CROSS-REFERENCE TO RELATED APPLICATION

The present application is a U.S. National Stage Application of International Application No. PCT/US2013/072010 filed Nov. 26, 2013, which is incorporated herein by reference in its entirety for all purposes.

BACKGROUND

The present invention relates generally to equipment utilized in conjunction with operations performed in subterranean wells, and more particularly to surface feature improvements to a downhole fluid flow control device operable to control the inflow and outflow of injection fluids.

In certain subterranean formations, fluid is injected into the reservoir to displace or sweep the hydrocarbons out of the reservoir. This method of stimulating production is sometimes referred to as a method of "Enhanced Oil Recovery" and may be called water flooding, gas flooding, steam injection, etc. For the purpose of this specification, the general process will be defined as injecting a fluid (gas or liquid) into a reservoir in order to displace, drive, or increase the production of the existing hydrocarbons into a producing well.

Without limiting the scope of the disclosure, its background will be described with reference to steam injection into a hydrocarbon bearing subterranean formation, as an example. In wells having multiple zones, due to differences in the pressure and/or permeability of the zones as well as pressure and thermal losses in the tubular string, the amount of steam entering each zone may be difficult to control. One way to assure the desired steam injection at each zone is to establish a critical flow regime through nozzles or orifices associated with each zone. The number and size of the orifices may be varied in order to control the injection of steam. For example, smaller orifice sizes result in reduced flow area, which ultimately reduces the flow rate of steam through the orifice.

Injecting steam into a downhole tubular often results in a combination of fluids (i.e., vapor and water condensate) developing in the interior of the downhole tubular. The vapor and water travel down the inner diameter ("ID") of the downhole tubular without any particular pattern. Some of the fluids are blown out through the orifices, but most flow past the orifices to the bottom of the wellbore, where the water condensate tends to collect, resulting in a high vapor content injection uphole and a low vapor injection content downhole. Further, without any particular guidance for the fluids through the orifices, the large amounts of condensate flowing to the bottom of the wellbore may damage the lowest zone of production.

Figure 1:
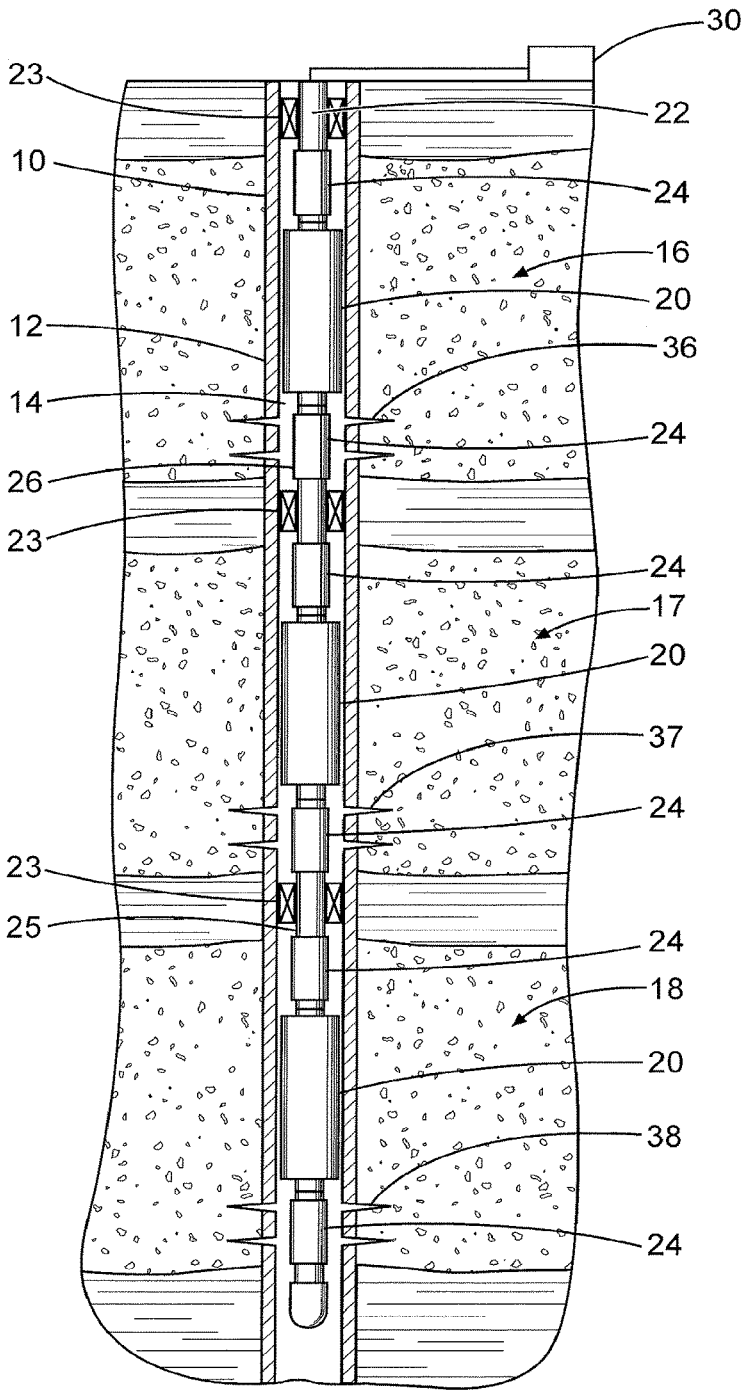
FIG. 1 is a schematic illustration of a well system operating a fluid flow control system during an injection phase of well operations, in accordance the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and are not exhaustive of the scope of the disclosure.

DETAILED DESCRIPTION OF THE DRAWINGS

Illustrative embodiments of the present disclosure are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells, monitoring wells, and production wells, including hydrocarbon or geothermal wells.

The terms "couple" or "couples" as used herein are intended to mean either an indirect or a direct connection. Thus, if a first device couples to a second device, that connection may be through a direct connection, or through an indirect mechanical, acoustical, or electrical connection via other devices and connections. The term "uphole" as used herein means on the earth's surface above a wellbore or drillstring, and "downhole" as used herein means below the earth's surface in or along a wellbore or drillstring, extending from the surface to the distal end. The term "upstream" as used herein means towards the earth's surface above a wellbore or drillstring, and "downstream" as used herein means away from the earth's surface in or along a wellbore or drillstring, extending from the surface to the distal end.

The present invention relates generally to equipment utilized in conjunction with operations performed in subterranean wells, and more particularly to surface feature improvements to a downhole fluid flow control device operable to control the inflow and outflow of injection fluids. It will be understood that the term "oil well drilling equipment" or "oil well drilling system" is not intended to limit the use of the equipment and processes described with those terms to drilling an oil well. The terms also encompass drilling natural gas wells, non-hydrocarbon, or hydrocarbon wells in general. Further, such wells can be used for production, monitoring, or injection in relation to the recovery of hydrocarbons or other materials and energy from the subsurface.

Referring to FIG. 1, a well system is depicted including one or more fluid flow control devices 20 positioned in a downhole tubular string 22. The tubular string 22 may be coaxially disposed in a wellbore 10, which may have a casing 12 cemented (not shown) in the wellbore 10. "Tubular string" is used generically and includes injection, work, production, and other types of jointed or coiled tubing systems. An annular space 14 may be defined between the tubular string 22 and the casing 12 or wellbore 10. The tubular string 22 may include various packers 23, connectors 24, spacers 25, valves, and other equipment and tools, as is known in the art. The fluid flow control devices 20 may be positioned along the tubular string 22 adjacent selected perforated intervals of the casing 12 corresponding to zones 16, 17, 18 of the formation to be injected. The zones 16, 17, 18 are shown isolated by packers 23. In use, the fluid flow control device 20 delivers steam from a source 30 at the surface to the target zones. The casing 12 may be perforated at each of the zones 16, 17, 18 of interest at perforations 36, 37, 38. The fluid flow control device 20 may include a tubular housing, which may further include a sleeve (not shown), and a plurality of orifices (not shown). The wellbore is illustrated as vertical, but it is understood that the wellbore can be horizontal, deviated, etc., as would be appreciated by one of ordinary skill in the art.

As would be appreciated by one of ordinary skill in the art, the fluid flow control device 20 could be a Zonemaster™ (tradename) Injection System from Halliburton Energy Services, Inc., an Otis Sliding Side Door Circulating Device, or any suitable ported fluid flow control device known to those of ordinary skill in the art that could be used to direct fluids in the tubing bore through an orifice to the outside of the tubing. Suitable fluid flow control systems are disclosed in PCT/US13/48962, filed on Jul. 1, 2013, entitled Downhole Injection Assembly Having An Annular Orifice, and assigned to the assignee of the present application. This application discloses adjustable annular restrictions between the sleeve of a fluid flow device and the nipple above the ports of the fluid flow device, the adjustable annular restrictions replacing prior art circumferential orifices and providing for increased velocity and decreased pressure, resulting in improved mixing and entrainment of condensed water with the steam. The present disclosure, as applied to the above described application, may lead to improved redirection of fluids to the flow control device.

The present disclosure is directed at surface feature improvements to the inner diameter ("ID") or outer diameter ("OD") of a fluid flow control device to allow the control and/or manipulation of fluids in the fluid flow control device. Specifically, in one embodiment, the present disclosure is directed to a recessed or slightly raised profile and/or contour on the ID or OD of the fluid flow control device. In a second embodiment, the present disclosure is directed to slotted (i.e., rectangular, oval, or another similar shape) orifice with a higher aspect ratio than traditionally circular orifices.

In one embodiment in accordance with the present disclosure, the ID or OD of the fluid flow control device may include one or more recessed or slightly raised profiles to guide the flow of fluids toward a particular area. Specifically, the shape and depth of the profiles may be manipulated to control the amount of fluid that will be directed towards and then blown out through the orifices during injection. The profiles may be created through the removal of material in the ID of the fluid flow control device, or through the forming of the materials so that the ID or OD of the fluid flow control device is not reduced significantly. The profile may also be created through the addition of material to the ID or OD of the fluid flow control device.

Figure 2A:
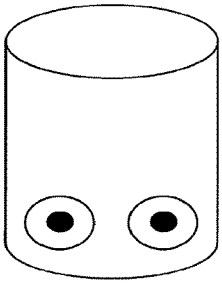
FIGS. 2A and 2B are schematic illustrations of a first embodiment of a flow control device in accordance with the present disclosure.
Figure 2B:
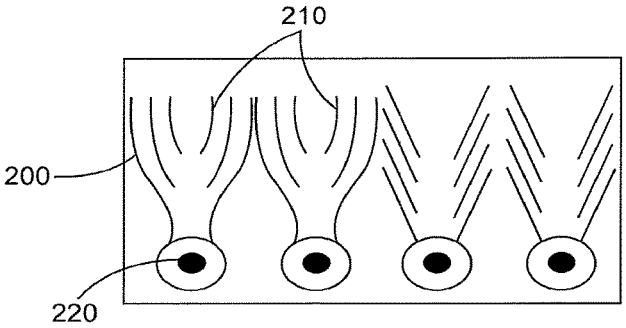

Referring now to FIGS. 2A and 2B, in certain embodiments in accordance with the present disclosures, the profile 200 of the ID or OD of the fluid flow control device may further include contour lines 210. The contour lines 210 may be curved or straight. The profile 200 may include a combination of recessed, slightly raised, curved, and/or straight contour lines 210. The contour lines 210 may sit above, or upstream relative to, a plurality of orifices 220 of the fluid flow control device. In this manner, the contour lines 210 may control the flow of condensate in the well. Specifically, the contour lines 210 may direct the downward flow of condensate in a vertical well during steam injection, or any other method of "Enhanced Oil Recovery," such as water flooding or gas flooding. Although the embodiments in this disclosure may be described with reference to steam injection methods, the improved device may be utilized in any method of "Enhanced Oil Recovery" known to one of ordinary skill in the art. The contour lines 210 may control the amount of fluid that will be directed towards or away from the orifices 220 of the fluid flow control device. In certain embodiments, the contour lines 210 may control the amount of fluid that exits through the orifices 220 during injection. In certain embodiments, the contour lines 210 may control the amount of steam that exits through the orifices 220 during injection by guiding fluid away from the orifices 220 so that only steam is directed through the orifices 220. In this manner, the improved device in accordance with the present disclosure may provide for both the control of steam flow and the control of condensate flow into and past the orifices 220.

As would be appreciated by one of ordinary skill in the art with the benefit of the present disclosures, various techniques may be utilized in order to achieve the profile(s) 200 discussed above. For example, the contour lines 210 may be rolled or stamped into a sheet of material used to form a sleeve of the fluid flow control device prior to the sheet being formed into a tube. The sheet may be formed into a tube via any suitable welding operation, including, but not limited to, seam welding. The contour lines 210 may also be rolled into a length of tube stock material that may be installed as a sleeve of the fluid flow control device. Moreover, low-yield strength materials may be used to enable roll forming and a seam welding operation, if applicable. As would be appreciated by one of ordinary skill in the art with the benefit of present disclosure, materials that may be used in this embodiment include, but are not limited to, common alloy and stainless steels, corrosion-resisting nickel alloy steels, precision investment cast carbide, or cobalt-based alloy materials. In this manner, the contour lines 210 may be placed on the ID or the OD of the fluid flow control device. Roll forming techniques may be more cost efficient and may provide for more complex profiles than fully-machined or precision investment cast sleeves.

In certain embodiments in accordance with the present disclosure, the ID of the fluid flow control device (i.e., in some embodiments, the sleeve) may be a removable insert that is installed after manufacture of the fluid flow control device, but before an injection job is run. Such removable sleeves may be equipped with a variety of geometries, including, but not limited to, a restricted ID, a profiled ID, mixing vanes, a flow-channel restrictor device, as described in PCT/US13/48962, or any other geometries known to those of skill in the art to alter flow profile. These geometries may interfere with through-bore well intervention access, but may improve mixing and distribution of "wet flow" and steam prior to passage through orifices 220 outside the casing 20 and into the reservoir (not shown). In the context of the present disclosure, "wet flow" refers to an accumulation of water droplets on the ID of the fluid flow control device that may be swept along with the steam flow. As would be appreciated by one of ordinary skill in the art with the benefit of the present disclosure, an aggressive accumulation of water droplets may merge to create undesirable "slugs" of water that may impart condensation-induced "waterhammer" forces to downhole completion equipment features.

As would be appreciated by one of ordinary skill in the art, in accordance with the present disclosure, the profile also may be created on the OD of the fluid flow control device to direct surface fluid flow. In this embodiment, the OD of the fluid flow control device may include a profile defined by one or more contour lines.

Figure 3A:
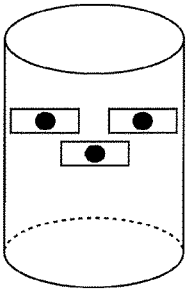
FIGS. 3A-3D are schematic illustrations of a second embodiment of a flow control device in accordance with the present disclosure.
Figure 3B:
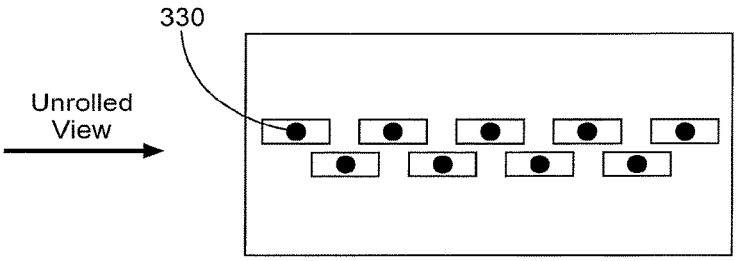

In another embodiment in accordance with the present disclosure, the fluid flow control device may include slotted orifices with a higher aspect ratio than traditionally circular orifices. Referring now to FIGS. 3A and 3B, in the certain embodiments in accordance with the present disclosures, the fluid flow control device may comprise a plurality of slotted orifices 330. The slotted orifices 330 may be rectangular, oval, or of any other suitable geometry known to those of ordinary skill in the art. The slotted orifices 330 may have a higher aspect ratio than traditional circular orifices, but may have a total area comparable to that of traditional circular orifices. The slotted orifices 330 may have an aspect ratio greater than 1. The slotted orifices 330 may have a greater width than height. However, the width and height of the slotted orifices may be adjusted accordingly so long as the total area is comparable to that of traditional circular orifices. For example, a traditional circular orifice may have a 1-inch squared area, and a diameter of 1.14 inches. A slotted orifice with a similar area may have a length of 4 inches and a height of 0.25 inches. The term "aspect ratio," as used in the present disclosure, means the ratio of width to height of the orifice.

As used in this disclosure, the term "width" refers to the length of the slotted orifice 330 in the hoop direction, and the term "height" refers to the length of the slotted orifice 330 in the axial direction. The slotted orifice 330 with a higher aspect ratio than traditional circular orifices may provide for a large circumference of the ID of the fluid flow control device to capture the vertical flow of the condensate in the fluid flow control device.

In certain embodiments in accordance with the present disclosure, the slotted orifices 330 may be positioned on the fluid flow control device in a staggered configuration. In this manner, the condensate may always come in contact with a slotted orifice 330. Alternatively, the configurations (i.e., positioning) of the slotted orifices 330 on the fluid flow control device may be designed to allow a certain percentage of the condensate to flow vertically to the next zone. In this manner, the configuration of the slotted orifices 330 may allow for even distribution of condensate among the several zones. For example, in a well having four zones, one configuration of the slotted orifices 330 may be located above, or upstream relative to, the first zone and may be designed to inject 25% of the condensate into the first zone. Another configuration of the slotted orifices 330 may be located above, or upstream relative to, the second zone and may be designed to inject 33% of the condensate into the second zone. Yet another configuration of slotted orifices 330 may be located above, or upstream relative to, the third zone and may similarly be designed to inject 33% of the condensate into the third zone. In this manner, only a small percentage of condensate (i.e., 9%) may be injected into the fourth zone. In another example, in the same well having four zones, a configuration of the slotted orifices 330 may be located above, or upstream relative to, the first zone and may be designed to inject 100% of the condensate into the first zone. As would be appreciated by one of ordinary skill in the art with the benefit of the present disclosure, any configuration of slotted orifices 330 may be used in accordance with the present disclosure to provide for any percentage distributions of condensate within each zone. The ability to utilize different configurations for different zones provides for optimization of the fluid flow control within the well.

Figure 3C:
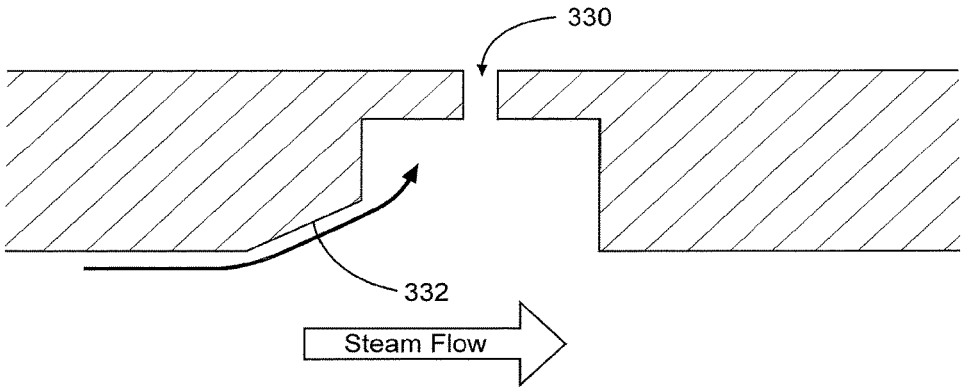
Figure 3D:
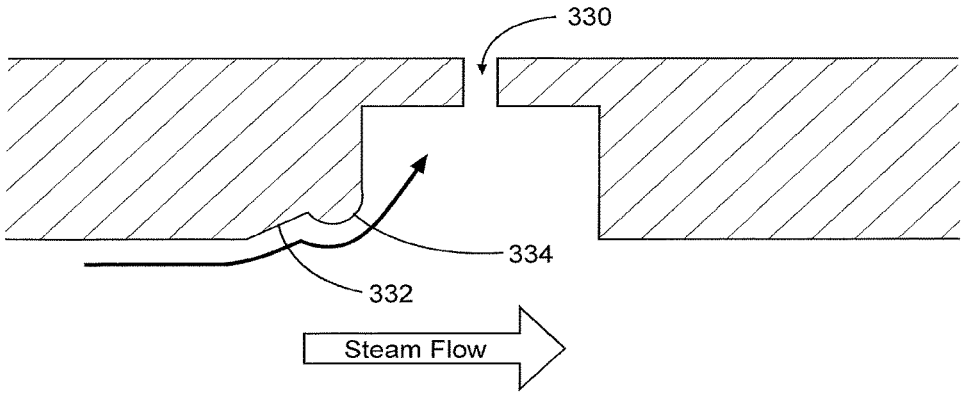

Referring now to FIGS. 3C and 3D, in certain embodiments, the slotted orifices 330 may include a taper 332 to optimize the collection and injection of condensate. The taper 332 may include a beveled edge, which may be coupled to a deflector 334 adjacent to the slotted orifices 330, such that flow may follow a contoured approach to channel fluid (i.e., steam and/or condensate) to the slotted orifice 330 where it may be entrained and discharged more efficiently.

As would be understood by one of ordinary skill in the art with the benefit of this disclosure, various methods of controlling the inflow and outflow of injection fluids are provided. In one embodiment, a method of controlling the inflow and outflow of injection fluids into a wellbore includes the step of positioning at a downhole location a fluid flow control device. The fluid flow control device may include a tubular housing having an inner diameter and an outer diameter, wherein the inner diameter and outer diameter may each further include profiles. The profiles may include contour lines, in accordance with certain embodiments of the present disclosure. The fluid flow control device may further include a plurality of orifices on the tubular housing. The plurality of orifices may be slotted. The method may further include the steps of flowing a fluid into the tubular housing, collecting a condensate from the fluid proximate the plurality of orifices, directing the condensate through the plurality of orifices utilizing a surface feature improvement, and injecting the condensate into a zone of interest downhole. As would be appreciated by one of skill in the art, the condensate may be guided to at least one of the plurality of orifices with the aid of the surface feature improvement. In accordance with certain embodiments of the present disclosure, the surface feature improvement may comprise the contour lines and/or a staggered configuration of the plurality of slotted orifices.

Accordingly, surface feature improvements are disclosed for collecting steam and directing it to the orifices so that it can later be injected to the zone of interest downhole. The surface feature improvements provide for the control and manipulation of the entrainment of fluids to the orifices. Without a geometry feature to guide the flow of steam, the steam will not be guided into the orifices. The geometry will help the vapor and water exit through the orifices. Moreover, the geometry may be designed for different zones to optimize the ability to inject steam into all the zones. Without geometry to guide the water out of the orifices, the water flows to the bottom and there is a large collection of water at the bottom of the sleeve of the fluid flow control device.

An embodiment of the present disclosure is a downhole fluid flow control apparatus. The fluid flow control apparatus includes a substantially tubular housing having an inner diameter and an outer diameter, the inner diameter having a profile defined by one or more contour lines. The fluid flow control apparatus further includes a plurality of circular orifices defined on the tubular housing.

Preferably, the one or more contour lines have a shape selected from the group consisting of curved, straight, recessed or slightly raised. Preferably, the one or more contour lines are located upstream relative to the plurality of orifices, and the contour lines are operable to direct a fluid into the plurality of orifices. Optionally, the one or more contour lines are operable to guide a fluid away from the plurality of orifices. Optionally, the tubular housing includes a sleeve, the sleeve having a profile defined by one or more contour lines. Optionally, the sleeve is formed from a sheet of material, and the contour lines are rolled or stamped into the sheet of material. Optionally, the sleeve is a removable insert of the tubular housing. Preferably, the sleeve may include one of a restricted inner diameter, a profiled inner diameter, mixing vanes, or a flow-channel restrictor. Optionally, the outer diameter comprises a profile, the outer diameter profile having one or more contour lines.

Another embodiment of the present disclosure is a downhole fluid flow control apparatus that includes a substantially tubular housing and a plurality of slotted orifices defined on the tubular housing. Preferably, the slotted orifices may be rectangular, oval orifices, or a similar shape. Preferably, the slotted orifices have an aspect ratio greater than 1. Preferably, the slotted orifices are positioned on the fluid flow control device in a staggered configuration. Optionally, at least one of the plurality of slotted orifices is formed with a taper. Optionally, the plurality of slotted orifices having a taper further includes a deflector coupled to the taper and adjacent to the slotted orifice.

Another embodiment of the present disclosure is a method for controlling the inflow and outflow of injection fluids into a wellbore. The method includes positioning at a downhole location a substantially tubular housing having an inner diameter, an outer diameter, and a plurality of orifices, the inner diameter and outer diameter having profiles. The method further includes flowing a fluid into the substantially tubular housing. The method further includes collecting a condensate from the fluid proximate the plurality of orifices. The method further includes directing the condensate through the plurality of orifices utilizing a surface feature improvement. The method further includes injecting the condensate into a zone of interest downhole.

Preferably, the surface feature improvement is one of contour lines on one of the profile of the inner diameter or the profile of the outer diameter. Preferably, the condensate is guided to at least one of the plurality of orifices by the contour lines. Preferably, the surface feature improvement is a slotted orifice. Preferably, the condensate is guided to at least one of the plurality of orifices by a staggered configuration of the plurality of slotted orifices.

Therefore, the present disclosure is well-adapted to carry out the objects and attain the ends and advantages mentioned as well as those which are inherent therein. While the disclosure has been depicted and described by reference to exemplary embodiments of the disclosure, such a reference does not imply a limitation on the disclosure, and no such limitation is to be inferred. The disclosure is capable of considerable modification, alteration, and equivalents in form and function, as will occur to those ordinarily skilled in the pertinent arts and having the benefit of this disclosure. The depicted and described embodiments of the disclosure are exemplary only, and are not exhaustive of the scope of the disclosure. The terms in the claims have their plain, ordinary meaning unless otherwise explicitly and clearly defined by the patentee.

What is claimed is:

1. A downhole fluid flow control apparatus comprising:

a substantially tubular housing having an inner diameter and an outer diameter;

the inner diameter having a profile defined by one or more contour lines; and a plurality of circular orifices defined on the tubular housing, wherein a first contour line of the one or more contour lines is operable to direct a fluid into the plurality of circular orifices and a second contour line of the one or more contour lines is operable to direct a fluid away from the plurality of circular orifices.

2. The apparatus of claim 1, wherein the one or more contour lines have a shape selected from the group consisting of curved, straight, recessed or slightly raised.

3. The apparatus of claim 1, wherein the one or more contour lines are located upstream relative to the plurality of circular orifices.

4. The apparatus of claim 1, wherein the tubular housing further comprises a sleeve, the sleeve having a profile defined by one or more contour lines.

5. The apparatus of claim 4, wherein the sleeve is formed from a sheet of material, and wherein the contour lines are rolled or stamped into the sheet of material.

6. The apparatus of claim 4, wherein the sleeve is a removable insert of the tubular housing.

7. The apparatus of claim 6, wherein the sleeve comprises one of a restricted inner diameter, a profiled inner diameter, mixing vanes, or a flow-channel restrictor.

8. The apparatus of claim 1, wherein the outer diameter comprises a profile, the outer diameter profile having one or more contour lines.

9. A downhole fluid flow control apparatus comprising:

a substantially tubular housing having a profile defined by one or more contour lines; and a plurality of slotted orifices defined on the tubular housing, wherein a first contour line of the one or more contour lines is operable to direct a fluid into the plurality of slotted orifices and a second contour line of the one or more contour lines is operable to direct a fluid away from the plurality of slotted orifices.

10. The apparatus of claim 9, wherein the plurality of slotted orifices are selected from a group consisting of rectangular orifices and oval orifices.

11. The apparatus of claim 9, wherein each of the plurality of slotted orifices have a width and a height, and wherein the width is greater than the height.

12. The apparatus of claim 9, wherein the plurality of slotted orifices are positioned in a staggered configuration.

13. The apparatus of claim 9, wherein at least one of the plurality of slotted orifices is formed with a taper.

14. The apparatus of claim 13, wherein the at least one of the plurality of slotted orifices comprising a taper further comprises a deflector coupled to the taper and adjacent to the slotted orifice.

15. A method for controlling the inflow and outflow of injection fluids into a wellbore, comprising:

positioning at a downhole location a substantially tubular housing having an inner diameter, an outer diameter, and a plurality of orifices, wherein the inner diameter and outer diameter comprise profiles;

flowing a fluid into the substantially tubular housing;

collecting a condensate from the fluid proximate the plurality of orifices;

directing a portion of the condensate through the plurality of orifices utilizing a first surface feature improvement;

directing a portion of the condensate away from the plurality of orifices utilizing a second surface feature improvement; and injecting a portion of the condensate into a zone of interest downhole.

16. The method of claim 15, wherein the first surface feature improvement and the second surface feature improvement are one or more contour lines on one of the profile of the inner diameter or the profile of the outer diameter.

17. The method of claim 16, wherein the condensate is guided to at least one of the plurality of orifices by the one or more contour lines.

18. The method of claim 15, wherein the first surface feature improvement and the second surface feature improvement are a plurality of slotted orifices.

19. The method of claim 18, wherein the condensate is guided to at least one of the plurality of orifices by a staggered configuration of the plurality of slotted orifices.

* * * * *